US010814154B2

(12) United States Patent
Wang

(10) Patent No.: US 10,814,154 B2
(45) Date of Patent: Oct. 27, 2020

(54) MAGNETORESISTANCE ADJUSTMENT DEVICE OF FITNESS EQUIPMENT

(71) Applicant: KEEN NEEK CO., LTD., Taichung (TW)

(72) Inventor: Chin-Liu Wang, Taichung (TW)

(73) Assignee: KEEN NEEK CO., LTD., Taichung (TW)

( * ) Notice: Subject to any disclaimer, the term of this patent is extended or adjusted under 35 U.S.C. 154(b) by 55 days.

(21) Appl. No.: 16/136,228

(22) Filed: Sep. 19, 2018

(65) Prior Publication Data

US 2019/0083839 A1 Mar. 21, 2019

(30) Foreign Application Priority Data

Sep. 21, 2017 (TW) ..... 106132370 A

(51) Int. Cl.

| | |
|---|---|
| ***A63B 21/00*** | (2006.01) |
| ***A63B 22/06*** | (2006.01) |
| ***A63B 21/005*** | (2006.01) |
| ***A63B 21/008*** | (2006.01) |

(52) U.S. Cl.

CPC ..... *A63B 21/00069* (2013.01); *A63B 21/005* (2013.01); *A63B 21/0051* (2013.01); *A63B 21/0088* (2013.01); *A63B 22/06* (2013.01); *A63B 22/0605* (2013.01); *A63B 21/00192* (2013.01)

(58) Field of Classification Search

CPC ..... A63B 21/00069; A63B 21/0051; A63B 21/0088; A63B 21/00192; A63B 21/005; A63B 21/0069; A63B 22/0605; A63B 22/06

See application file for complete search history.

(56) References Cited

U.S. PATENT DOCUMENTS

| | | | | |
|---|---|---|---|---|
| 5,466,203 | A * | 11/1995 | Chen | A63B 21/0051 482/63 |
| 8,829,376 | B2 * | 9/2014 | Wei | A63B 21/0051 200/296 |
| 9,233,273 | B2 * | 1/2016 | Wang | A63B 22/0605 |
| 9,945,383 | B2 * | 4/2018 | Wang | F04D 17/16 |

(Continued)

*Primary Examiner* — Megan Anderson

(74) *Attorney, Agent, or Firm* — Bruce Stone LLP; Joseph A. Bruce

(57) ABSTRACT

An improved magnetoresistance adjustment device of fitness equipment suitable for using in a fan-type fitness equipment. The fitness equipment having a traction rope, and including: a resistance wheel mounted on the fitness equipment and having a wheel and an axle, the axle being mounted on the wheel; a magnetoresistive ring mounted on the resistance wheel; a fixing member fixedly mounted on the axle and having a positioning bolt, a direction of the fixing member extending to the magnetoresistive ring being a displacement direction; a displacement member having a displacement hole, a fixing portion and a magnetoresistive portion, the displacement hole allowing the positioning bolt to pass through, and the displacement member repeatedly displacing along the displacement direction to bring the magnetoresistive portion closer to or away from the magnetoresistive ring, and the fixing portion being connected to the traction rope and driven by the traction rope.

6 Claims, 10 Drawing Sheets

(56) References Cited

U.S. PATENT DOCUMENTS

| | | | | |
|---|---|---|---|---|
| 2005/0020410 | A1* | 1/2005 | Chang | A63B 21/0051 482/63 |
| 2010/0069205 | A1* | 3/2010 | Lee | A63B 21/0051 482/63 |

* cited by examiner

MAGNETORESISTANCE ADJUSTMENT DEVICE OF FITNESS EQUIPMENT

BACKGROUND OF THE INVENTION

Field of Invention

The present invention relates to a fitness equipment, and more particularly to an improved magnetoresistance adjustment device of fitness equipment.

Related Art

General gymnasiums are equipped with fitness equipment, among the equipment, for example, exercise bike is used in the same way as a bicycle. A user can achieve the purpose of exercise by pedaling on the pedals of the exercise bike.

Fan blades are arranged on the resistance wheel of a general windage type exercise bike, with the windage generated by the fan blades, the user must pedal on the pedals of the exercise bike with a larger force. When the exercise bike is used by a user with stronger or weaker pedaling force, the windage generated by the fan blades is often insufficient, resulting in the user being unable to get enough exercise; or if the speed is not fast enough, it is difficult to produce a corresponding windage, and the fitness effect cannot be achieved.

A general non-windage type exercise bike on the market is disposed with a metal ring 11 and a magnetoresistive device 12 on a resistance wheel 10, as shown in FIG. 1, the metal ring 11 surrounds the resistance wheel 10 of the exercise bike. The magnetoresistive device 12 is pivotally coupled to the resistance wheel 10, and another end of the magnetoresistive device 12 is disposed with a plurality of magnetoresistive units 121.

When in use, the user makes the magnetoresistive device 12 to pivot so that the magnetoresistive units 121 on the magnetoresistive device 12 and the metal ring 11 generate a resistance vortex. When the magnetoresistive device 12 is pivoted to different angles, a quantity of the magnetoresistive units 121 of the magnetoresistive device 12 corresponding to the metal ring 11 is different, so that the magnetoresistance generated is different.

However, an angle of rotation of the magnetoresistive device 12 and a resulted magnitude of magnetoresistance are not a simple linear relationship. When the user moves the magnetoresistive device 12 to different angles, it is necessary to go through the method of trial and error to find an angle at which the magnetoresistive device 12 causes a maximum magnetoresistance, resulting in the user must spend time adjusting the magnetoresistance.

In view of this, the present invention provides an improved magnetoresistance adjustment device of fitness equipment, so that the magnetoresistance of a magnetoresistance adjustment device of the general fitness equipment can be directly predicted without using the method of trial and error.

SUMMARY OF THE INVENTION

An object of the present invention is to solve the drawback that the magnetoresistance adjustment device of prior art exercise bikes cannot predict a magnitude of magnetoresistance.

In order to solve the above-mentioned drawback, the present invention is an improved magnetoresistance adjustment device of fitness equipment, which is suitable for using in a magnetoresistance type fitness equipment. The fitness equipment has a wheel mounted on the fitness equipment, the wheel has a mounting surface, the mounting surface has an axle thereon, and the improved magnetoresistance adjustment device of fitness equipment comprising:

a magnetoresistive ring mounted on the mounting surface of the wheel and surrounding a peripheral edge corresponding to the mounting surface;

a fixing member fixedly mounted on the axle, and the fixing member having a positioning bolt and a traction portion thereon, the traction portion having a traction hole;

a displacement member having a displacement hole, a fixing portion and a magnetoresistive portion, the displacement hole being an elongated hole for allowing the positioning bolt to pass through;

a traction rope, one end thereof being mounted on the fitness equipment, and another end being connected to the fixing portion after passing through the traction hole; and an elastic member in the form of a spring and having a first end and a second end, the first end being fixedly mounted on the positioning bolt, and the second end being fixedly mounted on the displacement member.

In one preferred embodiment, the wheel is circular so that the wheel has a circle center, and the axle penetrates through the wheel and is mounted at a position corresponding to the circle center.

In one preferred embodiment, a quantity of the positioning bolt is three, and each of the positioning bolts is a screw that is locked to the fixing member. The displacement hole is an elongated hole extending along the displacement direction. The displacement member has an attaching surface and a sliding surface, the attaching surface is attached to the fixing member, and the sliding surface is opposite to the attaching surface, the displacement hole penetrates through the attaching surface and the sliding surface, and a quantity of the displacement hole is three.

In one preferred embodiment, the displacement member [[is]] further has a fixing bolt thereon, the fixing bolt is mounted on the sliding surface, and the second end of the elastic member is mounted on the fixing bolt.

In one preferred embodiment, the magnetoresistive portion is located at one end of the displacement member away from the axle, and the magnetoresistive portion has a plurality of magnet magnetoresistive units thereon, and the magnets are arranged correspondingly to a shape of the magnetoresistive ring.

Thereby, the present invention can solve the drawback that the magnetoresistance adjustment device of prior art fitness equipment cannot predict a magnitude of magnetoresistance generated, so that a user can foresee a magnitude of resistance value of adjustment without using the method of trial and error.

DETAILED DESCRIPTION OF THE INVENTION

Figure 1:
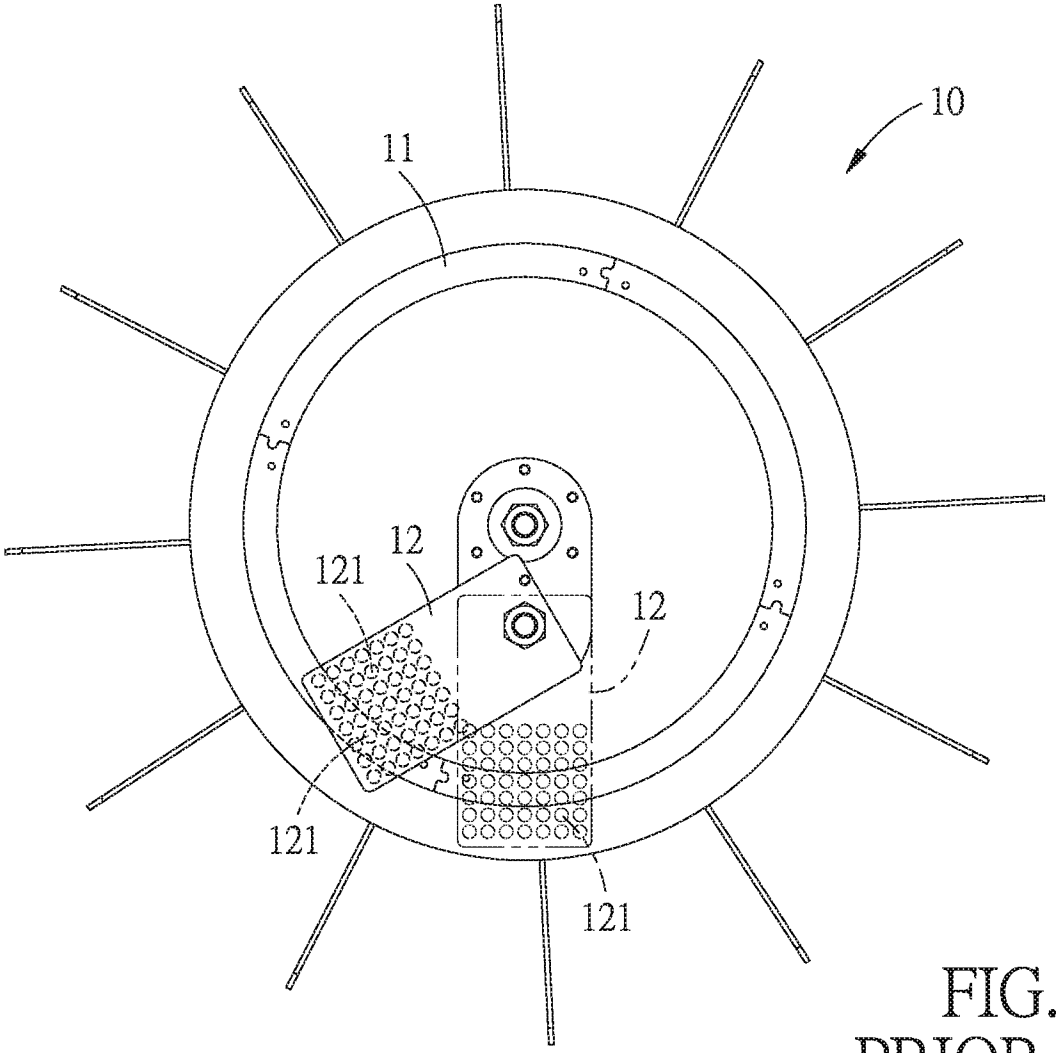
FIG.1 PRIOR ART
FIG. 1 is a schematic view of prior art resistance wheel and magnetoresistive device.
Figure 2:
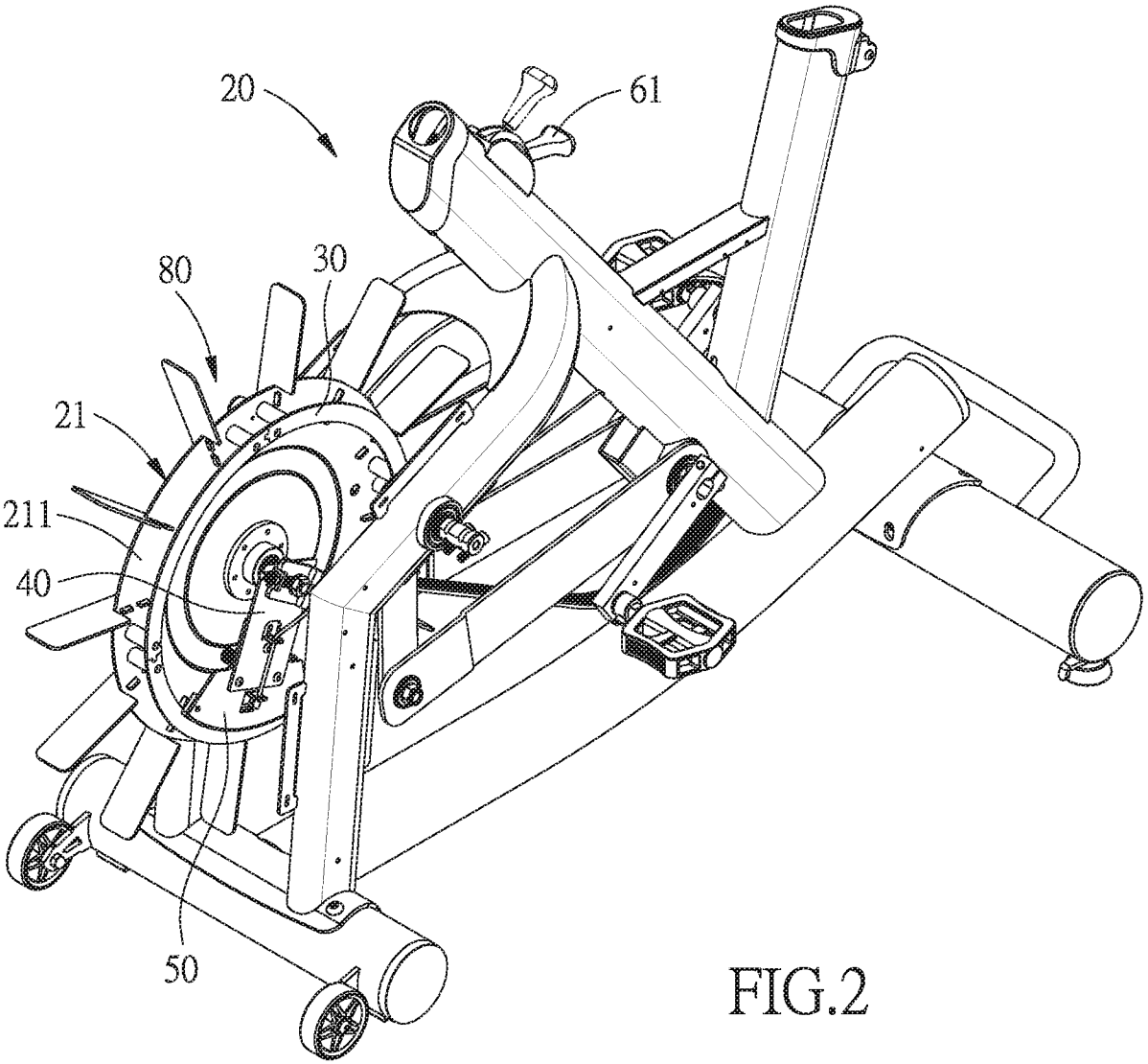
FIG. 2 is a perspective view of a fitness equipment according to a preferred embodiment of the present invention.
Figure 3:
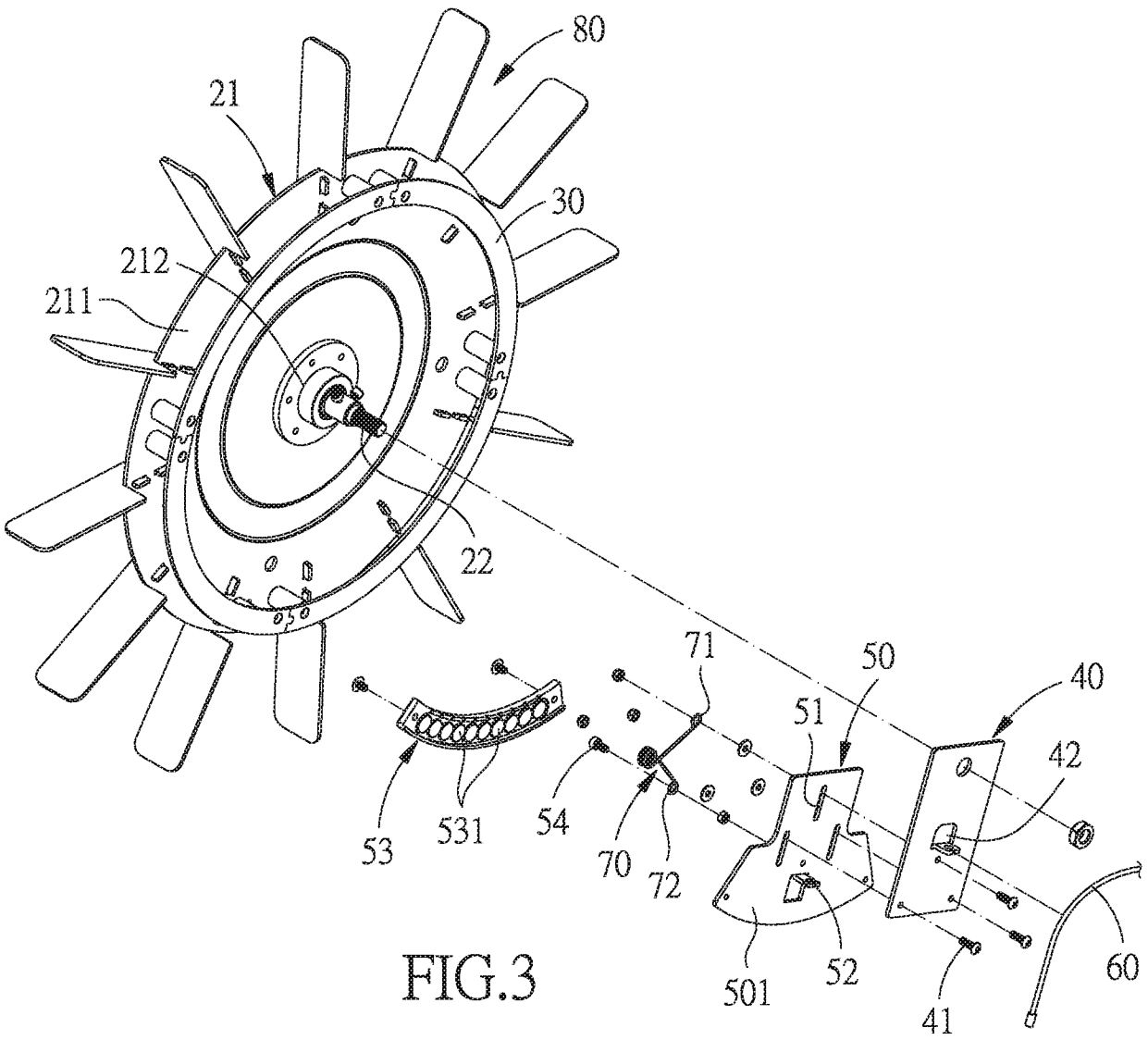
FIG. 3 is a perspective exploded view of a preferred embodiment of the present invention.

The foregoing and other technical contents, features and effects of the present invention to achieve the above object will be clearly presented in the following detailed description of the preferred embodiments with reference to the drawings.

Referring to FIG. 2 to FIG. 9, the present invention is an improved magnetoresistance adjustment device of fitness equipment, which is suitable for using in a fitness equipment 20. The fitness equipment 20 includes a wheel 21 having windage fan blades 80, the wheel 21 has a mounting surface 211, and the mounting surface 211 has an axle 22 thereon. In the embodiment, the wheel 21 is circular, so that the wheel 21 has a circle center 212, and the axle 22 penetrates through the wheel 21 and is mounted at a position corresponding to the circle center 212. The improved magnetoresistance adjustment device of fitness equipment comprises a magnetoresistive ring 30, a fixing member 40, a displacement member 50, a traction rope 60 and an elastic member (which is in the form of a spring) 70.

The magnetoresistive ring 30 is mounted on the mounting surface 211 and corresponds to a position of a peripheral edge of the mounting surface 211.

The fixing member 40 is fixedly mounted on the axle 22, and the fixing member 40 has at least one positioning bolt 41.

In this embodiment, the fixing member 40 further includes a traction portion 42 thereon, and the traction portion 42 has a traction hole 421 thereon.

A quantity of the positioning bolt 41 is three, and each of the positioning bolts 41 is a screw that is locked to the fixing member 40.

The displacement member 50 capable of displacing relatively along a displacement direction Y is mounted on the fixing member 40 (the circle center extends to a circumference). The displacement member 50 has at least one displacement hole 51, a fixing portion 52 and a magnetoresistive portion 53. A quantity of the displacement hole 51 is the same as a quantity of the positioning bolt 41. The displacement hole 51 allows the positioning bolt 41 to pass through, so that the displacement member 50 can be repeatedly displaced along the displacement direction Y to bring the magnetoresistive portion 53 closer to or away from the magnetoresistive ring 30.

In this embodiment, the magnetoresistive ring 30 is located between the displacement member 50 and the wheel 21.

The displacement member 50 has an attaching surface 501 and a sliding surface 502. The attaching surface 501 is attached to the fixing member 40, and the sliding surface 502 is a surface opposite to the attaching surface 501. The displacement hole 51 penetrates through the attaching surface 501 and the sliding surface 502, and a quantity of the displacement hole 51 is three.

Figure 8:
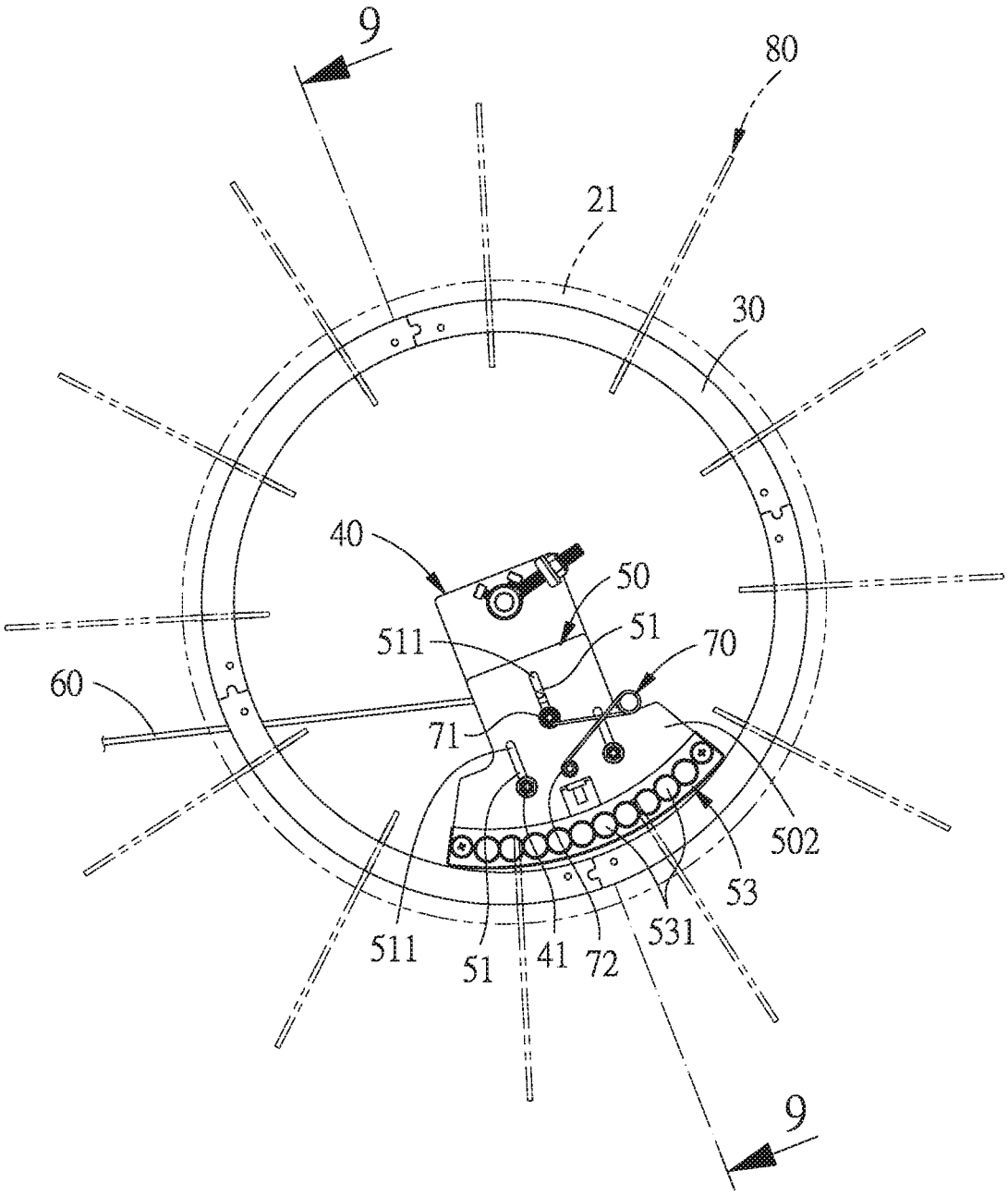
FIG. 8 is a schematic view of the present invention in a disengagement state according to a preferred embodiment.
Figure 10:
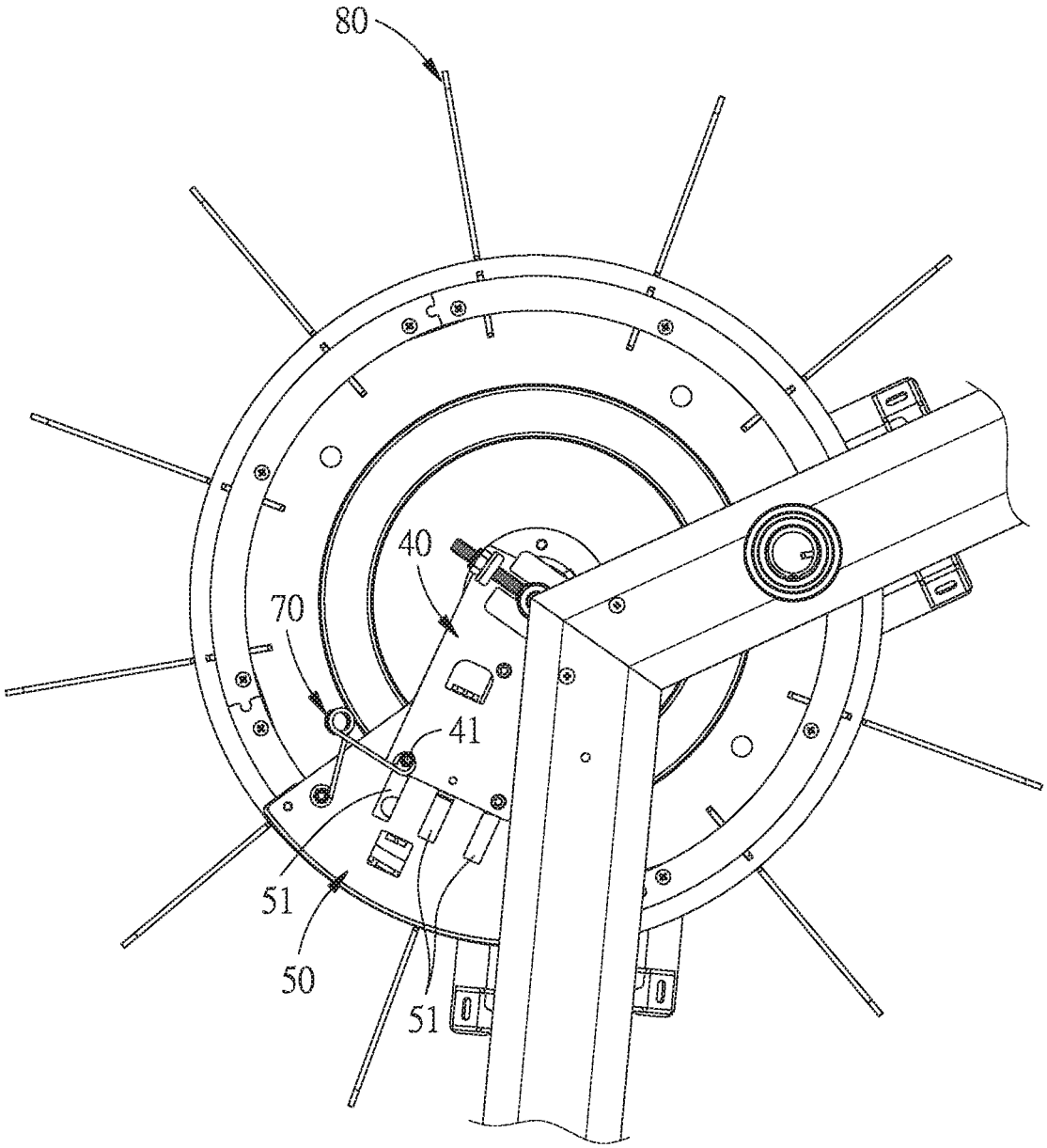
FIG. 10 is a partial enlarged view of another preferred embodiment of the present invention.

Referring to FIG. 8 and FIG. 10, the displacement hole 51 is an elongated hole extending along the displacement direction Y. The elongated hole can be an oblong hole or a rectangular hole, and the positioning bolts 41 can be a circular bolt or a square bolt; preferably, if the square bolt is used, each of the positioning bolts 41 can be more effectively prevented from moving slidably in the elongated hole. The displacement hole 51 has oppositely disposed high end 511 and low end 512, the high end 511 is closer to the axle 22 than the lower end 512, and the lower end 512 is closer to the magnetoresistive portion 53.

The displacement member 50 further includes a fixing bolt 54, and the fixing bolt 54 is mounted on the sliding surface 502.

The magnetoresistive portion 53 is located at one end of the displacement member 50 away from the axle 22, and the magnetoresistive portion 53 has a plurality of magnetoresistive units 531 in the form of magnets. The magnets 531 are arranged in a shape corresponding to an extending shape of the magnetoresistive ring 30. In this embodiment, the magnetoresistive portion 53 is arcuate.

One end of the traction rope 60 is mounted on the fitness equipment 20, and another end is connected to the fixing portion 52 for driving the fixing portion 52.

In this embodiment, the traction rope 60 is further connected to an adjusting member 61. The adjusting member 61 is mounted on the fitness equipment 20, one of the ends of the traction rope 60 is connected to the fixing portion 52 for driving the fixing portion 52, and the other end is connected to the adjusting member 61 and is driven by the adjusting member 61.

One of the ends of the traction rope 60 is connected to the adjustment member 61 and is driven by the adjusting member 61, and the other end passes through the traction hole 421 and is fixed to the fixing portion 52.

The elastic member 70 has a first end 71 and a second end 72. The first end 71 is fixedly mounted on the positioning bolt 41, and the second end 72 is fixedly mounted on the displacement member 50.

In this embodiment, the second end 72 of the elastic member 70 is mounted on the fixing bolt 54, and the elastic member 70 provides an elastic restoring force so that the displacement member 50 can move along the displacement direction Y.

The present invention has a maximum resistance state A and a disengagement state B.

Figure 4:
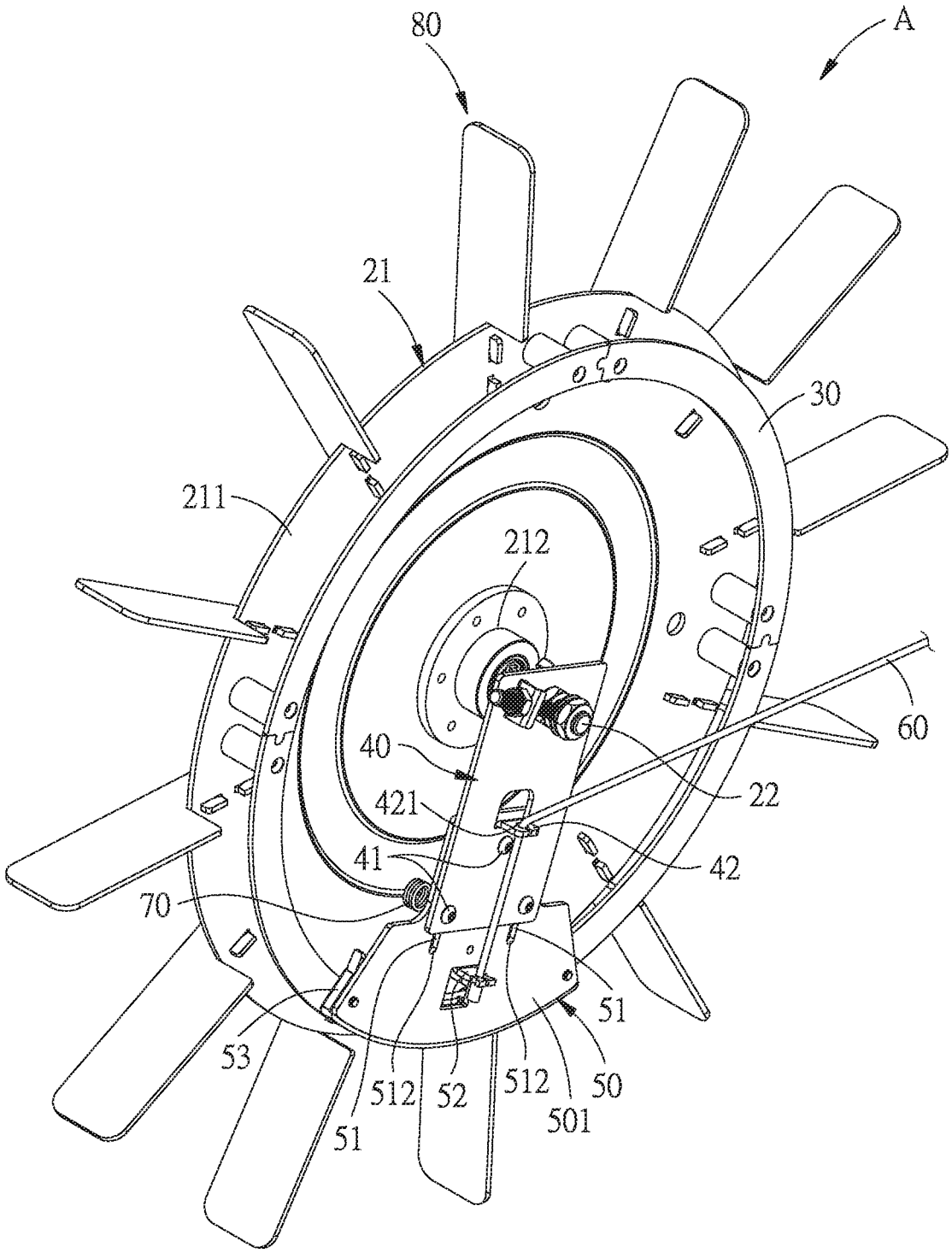
FIG. 4 is a perspective view of a resistance wheel and a magnetoresistive device according to a preferred embodiment of the present invention.
Figure 5:
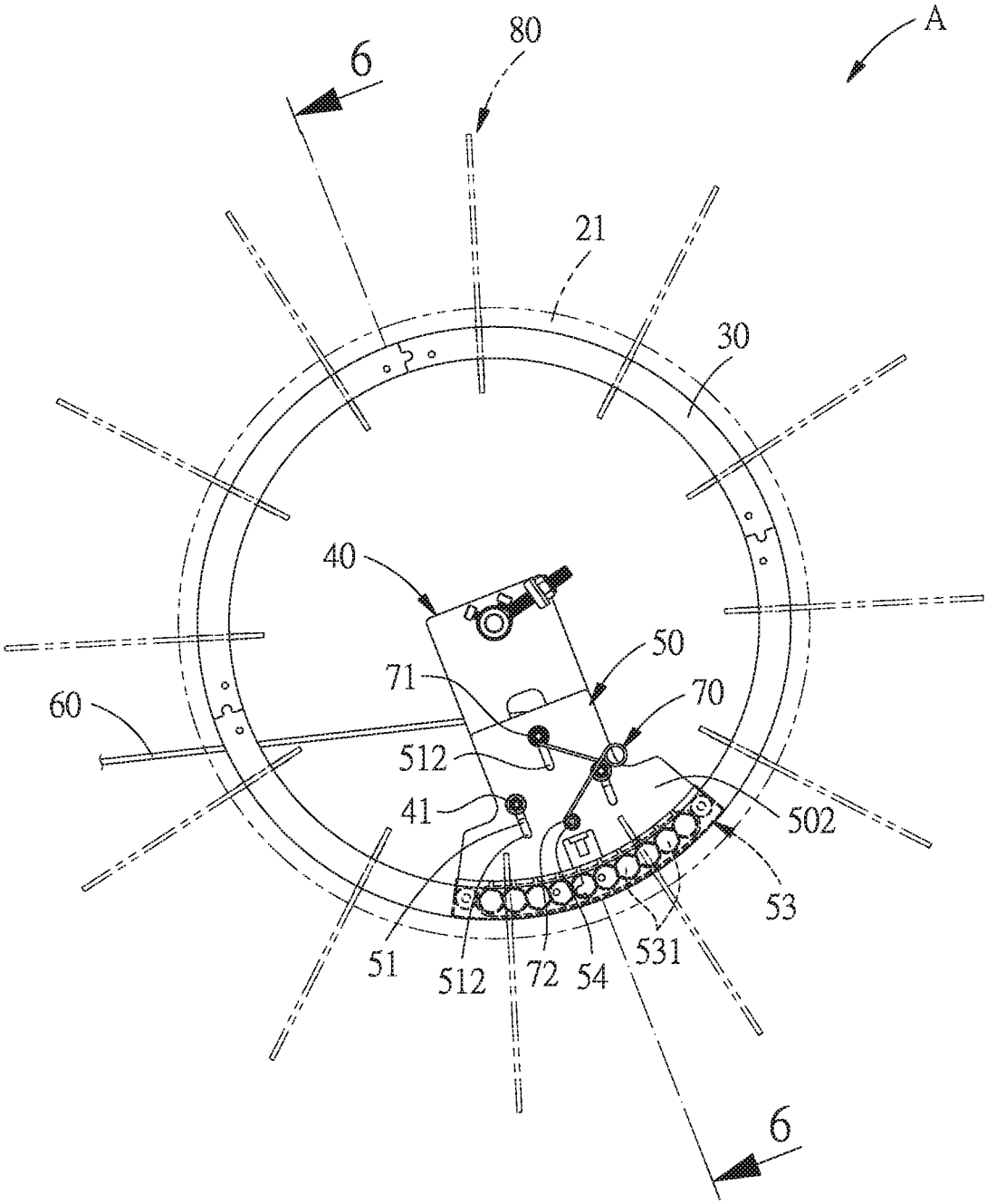
FIG. 5 is a schematic view of the present invention in a maximum resistance state according to a preferred embodiment.
Figure 6:
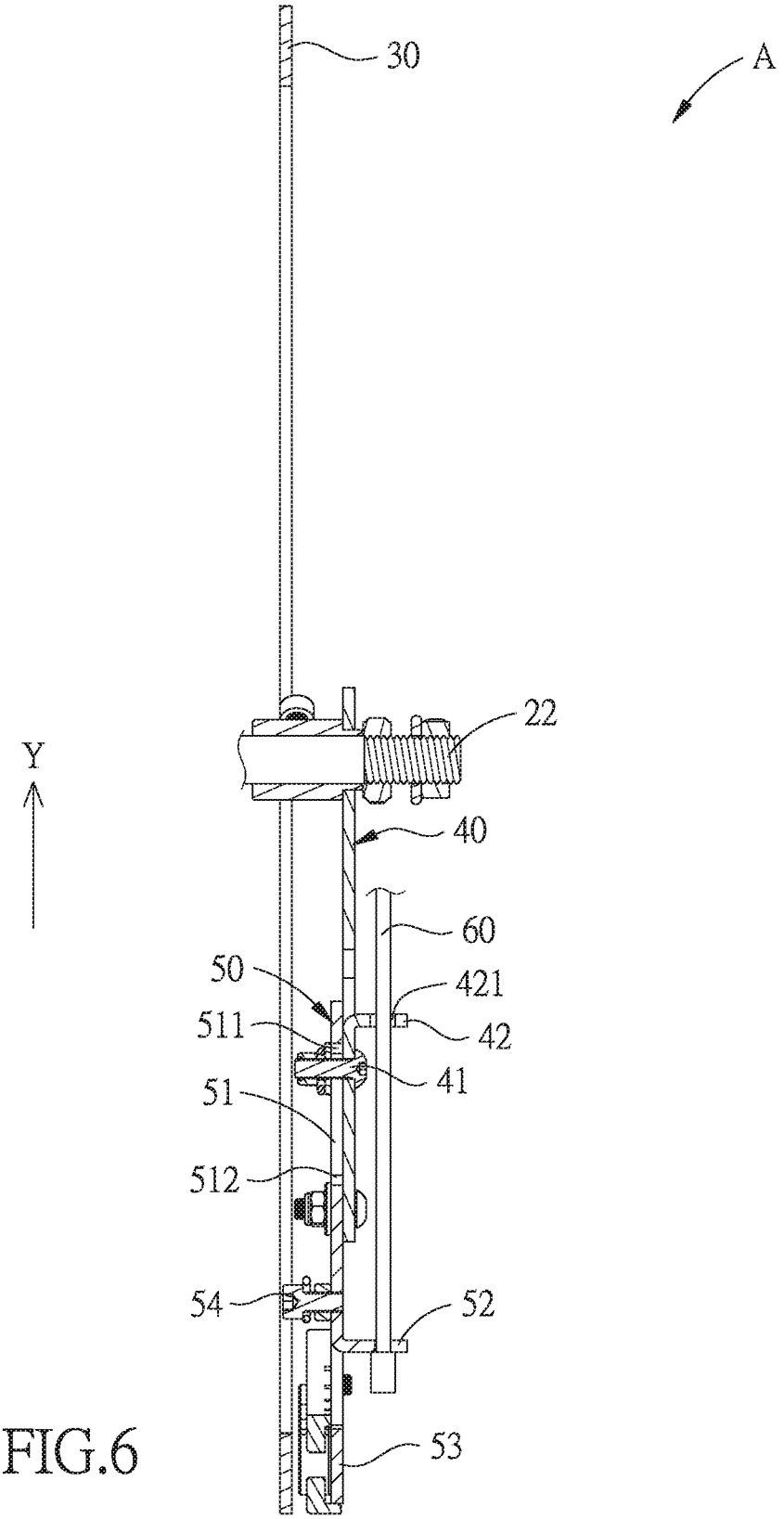
FIG. 6 is a cross-sectional view taken along line 6-6 of FIG. 5.

Referring to FIG. 4 to FIG. 6, when in the maximum resistance state A, the positioning bolt 41 at the high end 511 of the displacement hole 51 makes the magnetoresistive portion 53 at a position closest to the magnetoresistive ring 30. Simultaneously, the magnetoresistive units 531 of the magnetoresistive portion 53 generate a resistance vortex to the magnetoresistive ring 30, and further generate a resistance to the wheel 21 by electromagnetic damping of the resistance vortex.

Figure 7:
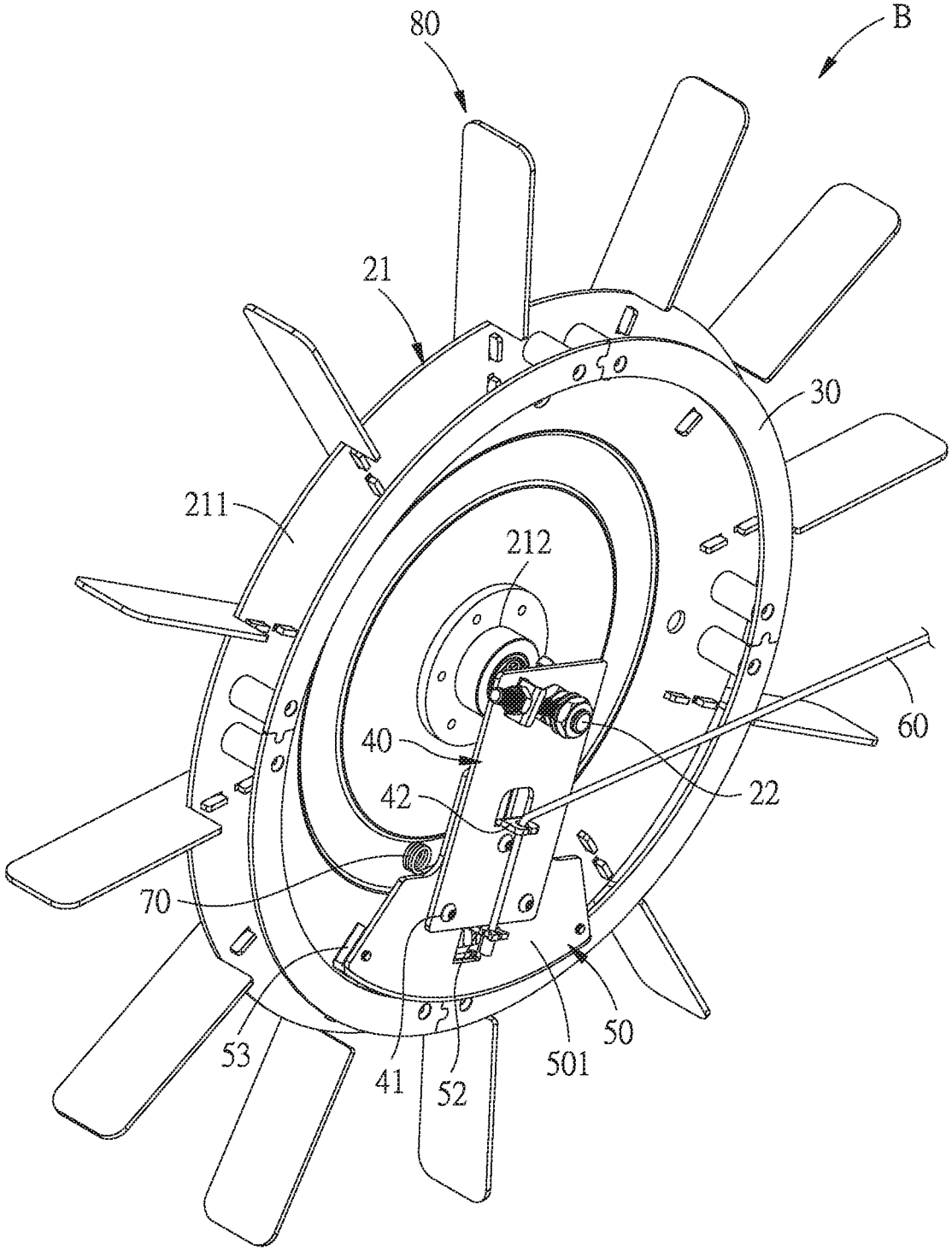
FIG. 7 is a perspective view of the present invention in a maximum resistance state according to a preferred embodiment.
Figure 9:
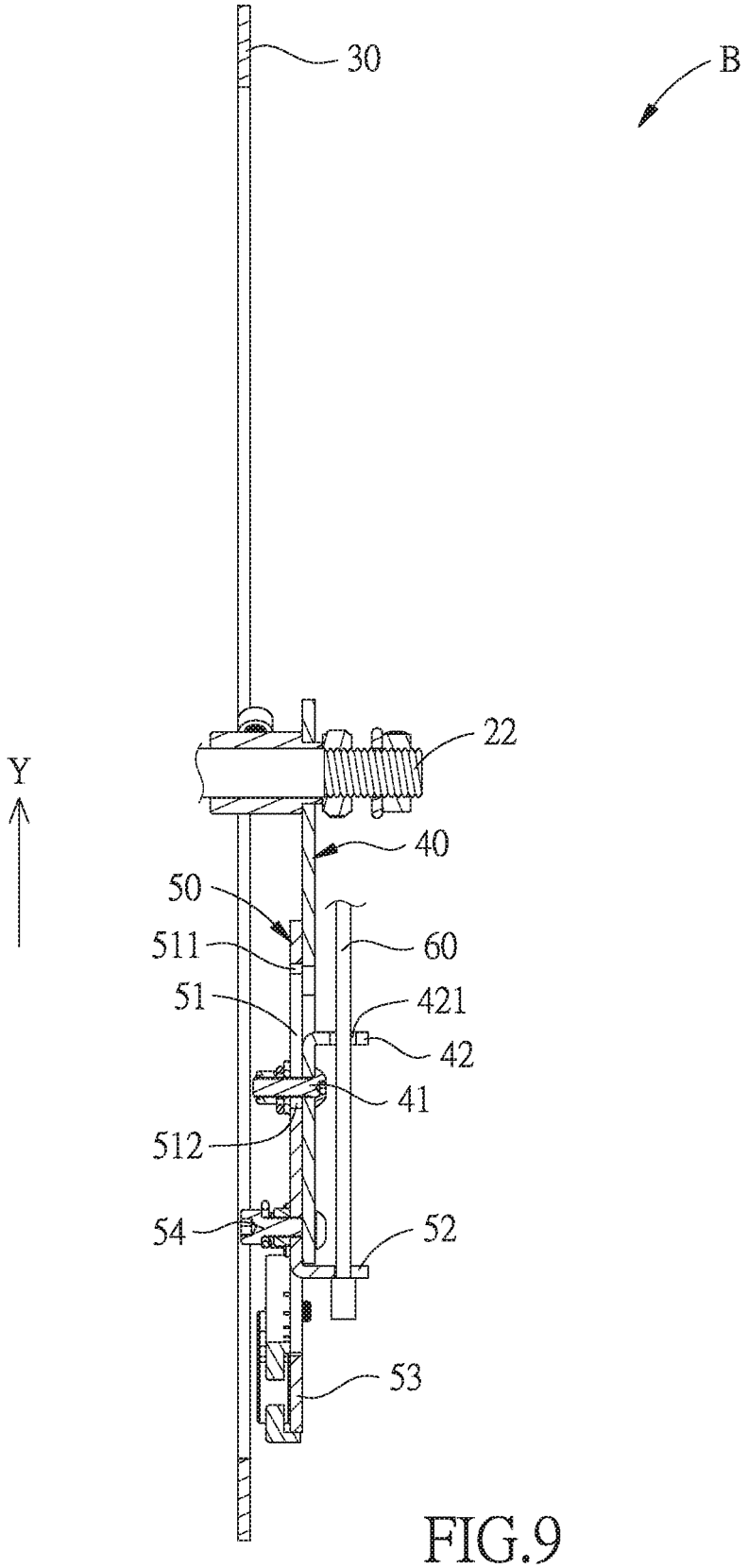
FIG. 9 is a cross-sectional view taken along line 9-9 of FIG. 5.

Referring to FIG. 7 to FIG. 9, when in the disengagement state B, the positioning bolt 41 at the lower end 512 of the displacement hole 51 makes the magnetoresistive portion 53 to move away from the magnetoresistive ring 30. Simultaneously, the further the magnetoresistive portion 53 is away from the magnetoresistive ring 30, each of the magnets 531 is disengaged from the magnetoresistive ring 30, and the magnets 531 do not generate a magnetoresistive vortex to the magnetoresistive ring 30, so that the magnets 531 do not generate a resistance to the magnetoresistive ring 30.

The above is the structural configuration and its connection relationship of the present invention. The method of usage of the present invention is as follows, and please refer to FIG. 4 to FIG. 9.

When the user wants to change the resistance, the adjusting member 61 must be pushed to cause the adjusting member 61 to drive the traction rope 60, so that the traction rope 60 drives the displacement member 50 to enable the displacement member 50 to move along the displacement direction Y.

When the user adjusts to the maximum resistance state A, the elastic member 70 can push the displacement member 50 along the displacement direction Y toward the magnetoresistive ring 30, and the positioning bolt 41 at the high end 511 of the displacement hole 51 enables a maximum magnetoresistive vortex generated between the magnetoresistive portion 53 and the magnetoresistive ring 30, thereby further providing the wheel 21 with a larger resistance.

When the user wants to adjust from the maximum resistance state A to the disengagement state B, the user pulls the adjusting member 61 to cause the adjusting member 61 to drive the traction rope 60, thereby allowing the traction rope 60 to move the displacement member 50 along the displacement direction Y toward the axle 22. The magnetoresistive portion 53 gradually moves away from the magnetoresistive ring 30 during the movement, so that the magnetoresistive vortex caused by the magnetoresistive portion 53 to the magnetoresistive ring 30 is gradually weakened, until the positioning bolt 41 is at the lower end 512 of the displacement hole 51, that is, in the disengagement state B, the magnetoresistive portion 53 does not have a magnetoresistive vortex generated between itself and the magnetoresistive ring 30, thereby preventing the wheel 21 from being affected by resistance.

Since the displacement member 50 can be repeatedly displaced along the displacement direction Y, when in the disengagement state B, the magnetoresistance portion 53 is completely disengaged from the magnetoresistive ring 30. When in the maximum resistance state A, the magnetoresistance portion 53 corresponds entirely to the magnetoresistive ring 30, thus the difference between a maximum resistance value and a minimum resistance value that can be caused by the present invention is large.

Thereby, the present invention can solve the drawback that the magnetoresistance adjustment device of the prior art fitness equipment 20 cannot predict a magnitude of magnetoresistance generated, that is, a magnitude of resistance value of adjustment can be foreseen.

In summary, the above embodiments and drawings are merely the preferred embodiments of the present invention, and the scope of implementation of the present invention is not limited thereto. In other words, all the equivalent changes and modifications made according to the appended claims shall still fall within the scope covered by the appended claims of the present invention.

What is claimed is:

1. An improved magnetoresistance adjustment device of fitness equipment, suitable for using in a magnetoresistance type fitness equipment, the fitness equipment having a wheel, the wheel having a mounting surface, the mounting surface having an axle thereon, and the improved magnetoresistance adjustment device of fitness equipment comprising:

a magnetoresistive ring mounted on the mounting surface of the wheel and surrounding a peripheral edge corresponding to the mounting surface;

a fixing member fixedly mounted on the axle, and the fixing member having a positioning bolt and a traction portion thereon, the traction portion having a traction hole;

a displacement member having a displacement hole, a fixing portion and a magnetoresistive portion, the displacement hole being an elongated hole for allowing the positioning bolt to pass through;

a traction rope, one end thereof being mounted on the fitness equipment, and another end being connected to the fixing portion after passing through the traction hole; and an elastic member in the form of a spring and having a first end and a second end, the first end being fixedly mounted on the positioning bolt, and the second end being fixedly mounted on the displacement member.

2. The improved magnetoresistance adjustment device of fitness equipment as claimed in claim 1, wherein the wheel is circular so that the wheel has a circle center, the axle penetrates through the wheel and is mounted at a position corresponding to the circle center, and the wheel has windage fan blades.

3. The improved magnetoresistance adjustment device of fitness equipment as claimed in claim 1, wherein the traction rope is further provided with an adjusting member, the adjusting member is mounted on the fitness equipment, one end of the traction rope is connected to the adjusting member and is driven by the adjusting member.

4. The improved magnetoresistance adjustment device of fitness equipment as claimed in claim 1, wherein the positioning bolt comprises three positioning bolts, and each of the positioning bolts is a screw that is locked to the fixing member; wherein the displacement hole comprises three displacement holes, each of the displacement holes is an elongated hole extending along the displacement direction, the displacement member has an attaching surface and a sliding surface, the attaching surface is attached to the fixing member, and the sliding surface is opposite to the attaching surface, and wherein each of the displacement holes penetrates through the attaching surface and the sliding surface.

5. The improved magnetoresistance adjustment device of fitness equipment as claimed in claim 1, wherein the displacement member has a fixing bolt thereon, the fixing bolt is mounted on the sliding surface, and the second end of the elastic member is mounted on the fixing bolt.

6. The improved magnetoresistance adjustment device of fitness equipment as claimed in claim 1, wherein the magnetoresistive portion is located at one end of the displacement member away from the axle, the magnetoresistive portion has a plurality of magnetoresistive units in the form of magnets thereon, and the magnetoresistive units are arranged correspondingly to a shape of the magnetoresistive ring.

* * * * *